US007319407B2

(12) United States Patent
Jang et al.

(10) Patent No.: US 7,319,407 B2
(45) Date of Patent: Jan. 15, 2008

(54) DISPLAY UNIT FOR REFRIGERATOR

(75) Inventors: Chan-Kyoo Jang, Changwon (KR); Ik-Kyu Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 360 days.

(21) Appl. No.: 11/013,791

(22) Filed: Dec. 17, 2004

(65) Prior Publication Data

US 2005/0134472 A1 Jun. 23, 2005

(30) Foreign Application Priority Data

Dec. 19, 2003 (KR) ..... 10-2003-0093746
Dec. 24, 2003 (KR) ..... 10-2003-0096611

(51) Int. Cl.
*G08B 3/00* (2006.01)
*G08B 19/02* (2006.01)

(52) U.S. Cl. ..... 340/691.1; 340/580; 340/585; 340/693.5; 340/693.9

(58) Field of Classification Search ..... 340/691.1
See application file for complete search history.

(56) References Cited

U.S. PATENT DOCUMENTS 4,387,578 A * 6/1983 Paddock ..... 62/127
5,831,816 A 11/1998 Johns et al.
6,430,946 B2 * 8/2002 Roh et al. ..... 62/125
6,715,302 B2 * 4/2004 Ferragut, II ..... 62/129
6,809,295 B1 * 10/2004 Vargas ..... 219/393
6,922,488 B2 * 7/2005 Mastrianni et al. ..... 382/199
6,961,003 B2 * 11/2005 Lin ..... 340/692
7,090,141 B2 * 8/2006 Roh et al. ..... 236/51
2001/0010516 A1 * 8/2001 Roh et al. ..... 345/169
2001/0025497 A1 * 10/2001 Roh et al. ..... 62/125
2002/0007486 A1 * 1/2002 Yun ..... 725/26
2002/0029575 A1 * 3/2002 Okamoto ..... 62/125
2003/0107492 A1 * 6/2003 Lin ..... 340/691.6
2003/0157893 A1 8/2003 Peeples
2006/0007357 A1 * 1/2006 Lee ..... 348/552
2006/0055553 A1 * 3/2006 Yeh ..... 340/692
2006/0098403 A1 * 5/2006 Smith ..... 361/683
2006/0174641 A1 * 8/2006 Liu et al. ..... 62/246

FOREIGN PATENT DOCUMENTS

JP S59-118992 8/1984
JP 35920393 A * 12/1984
JP H02/90592 3/1990
JP H08-118407 5/1996
JP H09-44166 2/1997
JP H09-250868 9/1997
WO WO 03/008885 1/2003

* cited by examiner

*Primary Examiner*—Julie Bichngoc Lieu
(74) *Attorney, Agent, or Firm*—Ked & Associates, LLP

(57) ABSTRACT

A display unit for a refrigerator is provided. The display having a TV receiving function is installed at a front surface of a refrigerator door. A mounting panel with a plurality of speaker holes formed therein is also installed around an edge of the display. A speaker is mounted to a rear surface of the mounting panel on a portion where the speaker holes are formed. Further, a resonance box is installed to enclose the speaker such that low and middle frequency sound can be transmitted forward to the outside. A sound transmission tube that communicates with the speaker hole is forced at a front portion of the resonance box. In addition, a sound absorbing material is covered on an inner rear surface of the resonance box that faces the rear of the speaker. A display as configured has improved sound quality.

22 Claims, 4 Drawing Sheets

DISPLAY UNIT FOR REFRIGERATOR

BACKGROUND OF THE INVENTION

1. Field of Invention

The present invention relates to a display unit installed at a door side of a refrigerator, and more particularly, to a display unit for a refrigerator capable of improving the performance of speakers for transmitting sound and thus the sound quality thereof.

2. Description of the Prior Art

In general, a top mount refrigerator in which freezing and refrigerating chambers are vertically formed and can be opened or closed by individual doors, respectively, has been widely used. However, as a refrigerator becomes larger, a side-by-side refrigerator in which freezing and refrigerating chambers are formed from side to side and can be opened or closed by individual doors that are pivoted on the lateral sides, respectively, is recently put on the market.

FIG. 1 shows a front view of a related art side-by-side refrigerator. As shown in the figure, a pair of doors 11 and 13 are installed from side to side to a main body 10 of a refrigerator. The doors 11 and 13 serve to open or close freezing and refrigerating chambers formed in the main body 10 of the refrigerator and installed on both sides of the main body 10 such that the doors can be pivoted on hinges h and h', respectively.

In order to meet a variety of consumer demands and prevent the loss of cold air in the chambers, a dispenser 15 capable of dispensing cold water or ice from the refrigerator has been recently installed on a refrigerating chamber door of a side-by-side refrigerator. Further, a display unit 17 having a TV receiving function is generally installed on a front surface of the refrigerating chamber door. Therefore, the display unit 17 having the TV receiving function allows a user to watch the TV in the kitchen where the refrigerator is placed.

The display unit 17 comprises a display 18 that is made of a relatively thin LCD and a panel 19 that defines an edge of the display. Further, the display unit 17 receives video and sound signals transmitted over the radio by means of circuit components embedded in the display unit such that the user can watch the TV through the display unit. In addition, a plurality of through-holes 20 are formed in the panel 19 of the display unit 17.

The through-holes 20 function as cooling holes for cooling a variety of components provided in the display unit 17 or as speaker holes for transmitting original sound generated from the speakers (not shown) provided in the display unit 17 to the outside of the display unit. Further, the speakers for generating sound are directly installed at the rear of the through-holes 20.

However, since the speakers of the TV are installed in a portion such as a refrigerator door on which spatial limitation is imposed in view of its thickness, there is a problem in that the sound transmission is not effective. That is, since sound generated forward of the speakers is merely transmitted to the outside via the through-holes, sound generated rearward of the speakers impinges directly on the refrigerating chamber door or freezing chamber door adjacent to the refrigerating chamber door and reflected in a diffuse manner. Therefore, there are problems in that low or middle frequency sound can be hardly heard as well as high-frequency sound is emphasized, whereby squealing sound is produced.

As seen from a graph shown in FIG. 6, effective sound transmission cannot be made in relatively low and middle frequency sound regions of the conventional transmitted sound. In addition, a sound level is partially increased in a high-frequency sound region such that a squealing sound is produced.

Therefore, it can be understood that in the sound region of the conventional sound, the transmission of low or middle frequency sound is not sufficient and a relatively high-frequency sound is partially amplified and transmitted.

Further, FIG. 2 shows a sectional view of the conventional through-holes 20. As shown in FIG. 2, the through-holes 20 passing back and forth through the panel 19 of the display unit 17 are formed to have the same diameter at the front and rear ends thereof.

However, since the display unit 17 is installed on a front surface of the door 13 of the refrigerator as described above, water drops may be introduced into the display unit 17 through the through-holes 20 when cleaning the refrigerator. Therefore, this may result in failure or malfunction of the circuit components installed within the display unit 17.

SUMMARY OF THE INVENTION

Accordingly, the present invention is conceived to solve the aforementioned problems in the prior art. An object of the present invention is to provide a sound system mounted with a display unit for a refrigerator capable of improving sound quality when watching the TV using the display unit.

Another object of the present invention is to provide a sound system for a refrigerator capable of preventing water from penetrating into a display unit of the refrigerator via through-holes.

According to the present invention for achieving the objects, there is provided a display unit for a refrigerator, comprising a display which is mounted to a front surface of the refrigerator, a mounting panel which is mounted around an edge of the display and formed with a plurality of speaker holes, a speaker which is installed on a rear surface of the speaker holes of the mounting panel to transmit sound, and a resonance box which is installed to have a predetermined space enough to accommodate the speaker therein and to enclose the speaker.

BRIEF DESCRIPTION OF THE DRAWINGS

The above and other objectives, features and advantages of the present invention will become apparent from the following description of a preferred embodiment given in conjunction with the accompanying drawings, in which.

DETAILED DESCRIPTION OF THE PREFERRED EMBODIMENT

Hereinafter, preferred embodiments of the present invention will be described with reference to the accompanying drawings.

Figure 3:
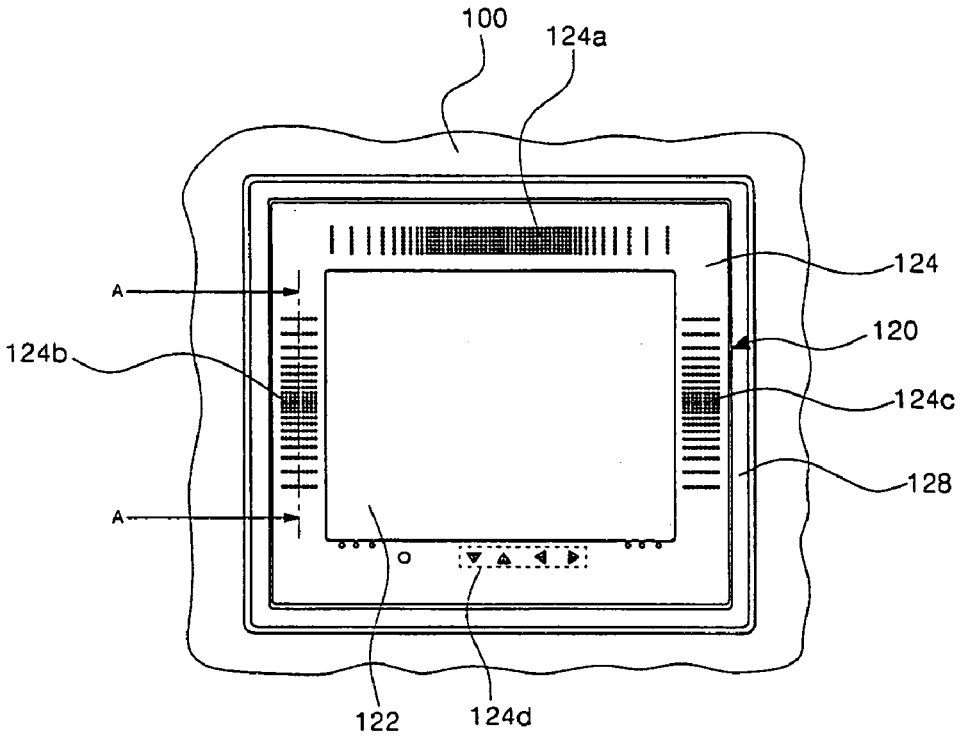
FIG. 3 is a partial front view of a refrigerator door mounted with a display unit according to the present invention.
Figure 4:
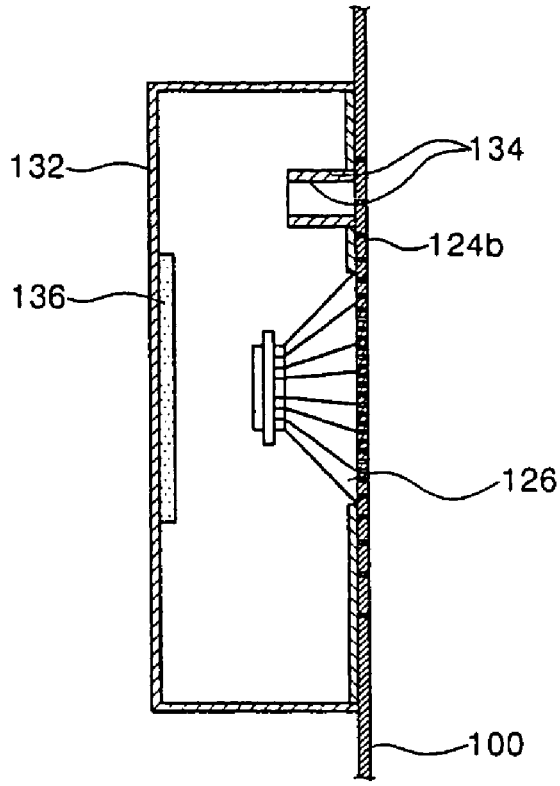
FIG. 4 is a sectional view taken along line A-A' of FIG. 3.

FIG. 3 is a front view showing a main part of a refrigerator mounted with a display unit according to the present invention, FIG. 4 is a sectional view taken along line A-A' of FIG.

Figure 5:
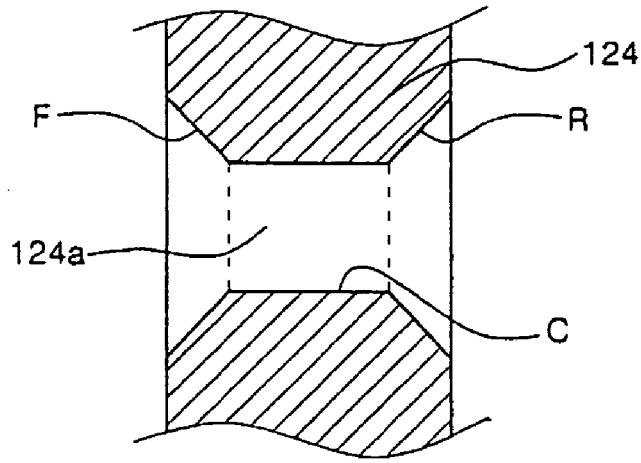
FIG. 5 is a sectional view of speaker holes according to the present invention.
Figure 6:
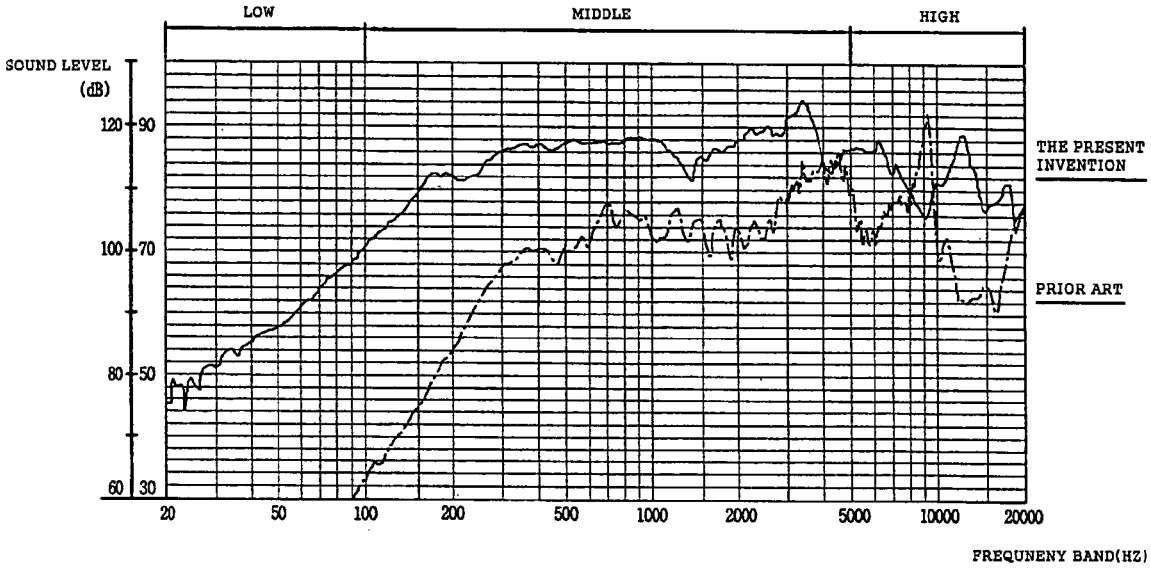
FIG. 6 is a graph illustrating the relationship between the level and frequency band of the sound generated from speakers according to the related art and the present invention.

3, FIG. 5 is a sectional view of through-holes according to the present invention, and FIG. 6 is a graph illustrating the relationship between the level and frequency band of sound generated from speakers according to the related art and the present invention.

Figure 1:
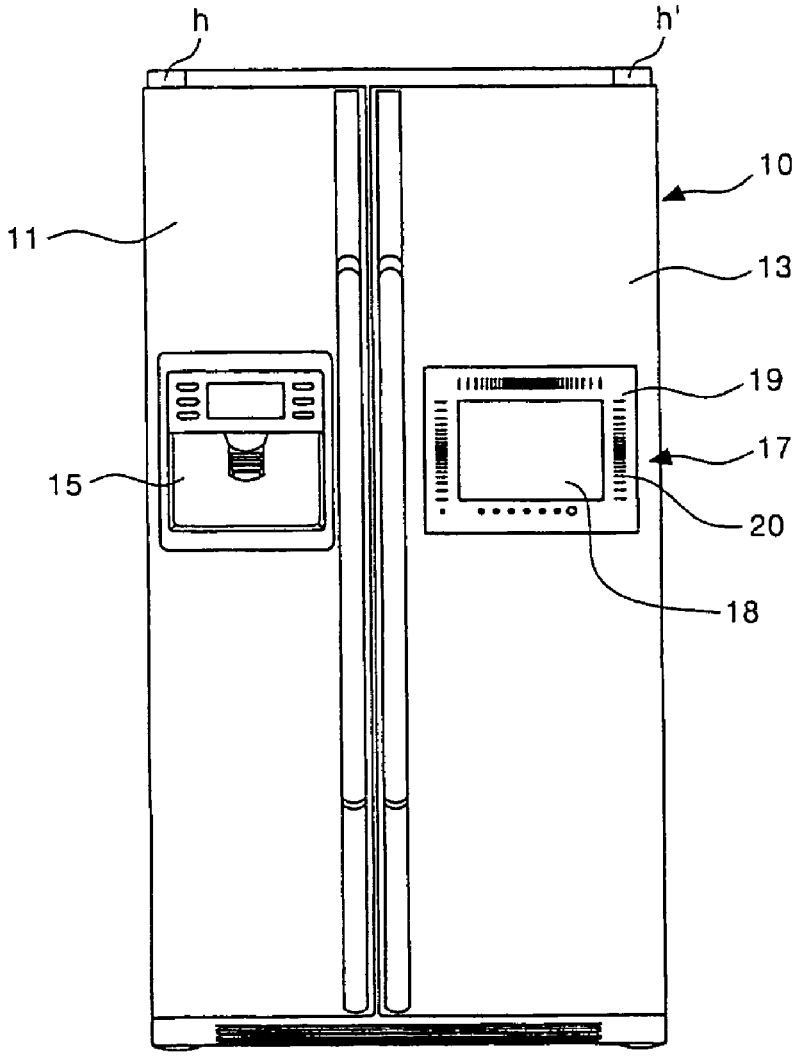
FIG. 1 Related Art
FIG. 1 is a front view of a refrigerator with a general display unit installed thereon.
Figure 2:
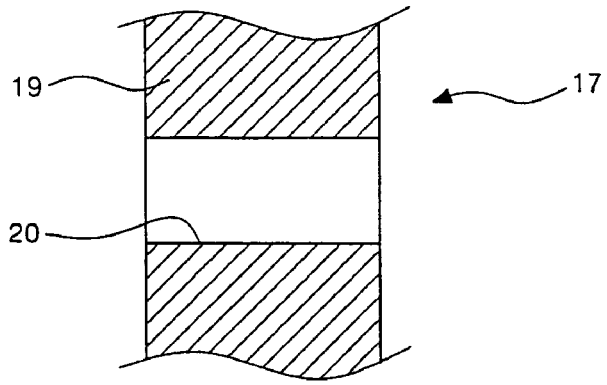
FIG. 2 Related Art
FIG. 2 is a sectional view of speaker holes according to the prior art.

The configuration of other parts of a refrigerator mounted with a display unit according to the present invention is the same as that shown in FIG. 1. Further, as shown in FIGS. 2 and 3, a display unit 120 is installed on a front surface of a refrigerating chamber door 100. In addition, since the display unit 120 has a TV receiving function, a user can watch the TV using the display unit 120 installed on the front surface of the refrigerator door.

Storage spaces such as freezing and refrigerating chambers are provided in the refrigerator at the rear of the refrigerator door. A plurality of shelves on which foodstuffs to be stored are placed are also provided in the storage spaces. Further, a plurality of door baskets are detachably installed at a rear surface of the door 100 to allow stored articles including a variety of foods to be placed therein.

Herein, the display unit 120 comprises a display 122 consisting of a thin LCD and a mounting panel 124 installed around an edge of the display 122, in consideration of the thickness of door. The display 122 consisting of LCD is a device for receiving the broadcast signal by means of circuit components installed within the display unit and displaying the received broadcast. Further, the mounting panel 124 installed around the edge of the display 122 is formed with a plurality of speaker holes 124*a*, 124*b* and 124*c*. An operating button 124*d* that a user manipulates to select a desired function of the display is also provided at the mounting panel 124.

As shown in FIG. 4, speakers 126 for converting electrical signals into sound waves and generating sound is provided at the rear of the speaker holes 124*a*, 124*b* and 124*c* of the mounting panel 124. Further, a controller (not shown) for controlling the operation of the display 122 and speakers 126 is provided at the rear of the operating button 124*d* of the mounting panel 124 in such a manner that the operating button 124*d* of the mounting panel 124 is connected with the display 122 and the speakers 126.

Of course, the display unit 120 may be installed on any one of the refrigerating and freezing chamber doors. When the display unit 120 is installed on the refrigerator door, an additional decoration panel 128 may be installed around the edge of the display unit 120 such that any mounting portions of the display unit cannot be exposed to the outside.

A rectangular resonance box 132 is provided at the rear of the speakers 126 that are installed at the rear of the speaker holes 124*a*, 124*b* and 124*c* formed in the mounting panel 124. The resonance box 132 is formed to have a space enough to accommodate the speakers 126 therein and covered on the rear side of the speakers 126. The resonance box 132 is a device for combining a sound generated from a front surface of the speakers 126 and a sound generated from and reflected on a rear surface of the speakers 126 so as to improve the quality of low and middle frequency sound.

At the front of the resonance box 132 is formed a sound transmission tube 134 with a predetermined length that is installed to communicate with the speaker holes 124*a*, 124*b* and 124*c* of the mounting panel 124 such that sound generated from the rear surface of the speakers 126 is reflected on and transmitted forward from the resonance box. Thus, since the sound that is reflected on and propagating forwardly from the resonance box 132 is transmitted to the outside in such a state where its sound pressure is increased while the sound passes through the sound transmission tube 134, the sound can be transmitted farther.

A sound absorbing material 136 capable of absorbing high frequency sound is installed on a rear surface of the resonance box 132 corresponding to the rear surface of the speakers 126. The sound absorbing material 136 can prevent the high frequency sound from being irregularly amplified by absorbing the high frequency sound. Further, it is preferred that the sound absorbing material 136 be a porous sound absorbing material with a plurality of holes formed thereon or therein. The sound absorbing material may be made of nonwoven fabrics, textile sheets, compressed sponges or the like. This sound absorbing material 136 serves to improve sound quality by allowing the high frequency sound of the sound generated from the speakers 126 to impinge on the interior of the fine holes and then be partially dissipated into thermal energy.

In a sound system for a refrigerator of the present invention so configured, when the display unit 120 mounted to the front surface of the refrigerator door 100 is turned on, a video screen is displayed on the display 122 and a sound is simultaneously transmitted to the outside through the speakers 126.

During the sound transmission, a sound generated from the front surface of the speakers 126 is directly transmitted to the outside through the plurality of speaker holes 124*a*, 124*b* and 124*c* formed in the mounting panel 124. At the same time, a sound generated from the rear surface of the speakers 126 is reflected on the resonance box 132 and transmitted through the sound transmission tube 134 with increased sound pressure thereof. Thus, the sound can be not only transmitted farther to the outside but also improved such that the low and middle frequency sound is heard louder.

Since the high frequency sound generated from the rear surface of the speakers 126 is absorbed in the fine holes of the sound absorbing material 136, sound energy can be converted and dissipated into thermal energy such that the occurrence of squealing sound is prevented and the sound quality of high frequency sound is also improved.

In addition, as shown in FIG. 6, the sound generated by the related art speakers was not well heard by the user because the sound level of low and middle frequency sound is low, and the squealing sound was also provided to the user because the sound level of high frequency sound is too high in some frequency bands. On the other hand, the improved sound quality can be provided to the user within an audible frequency band because the sound level of the low and middle frequency sound generated by the speakers to which the structure of the present invention is applied is further reinforced and the sound level of the high frequency sound thereof is relatively uniformly distributed as compared with the related art.

Next, the configuration of the speaker holes of the present invention is described with reference to FIG. 5. Hereinafter, one of the speaker holes 124*a* will be described as an example of the speaker holes.

The speaker hole 124*a* is formed to perforate forward through the mounting panel 124. Thus, as described above, the sound propagating forward from the speaker 126 and the sound propagating forward from the interior of the resonance box 132 through the sound transmission tube 134 can pass through the speaker hole 124*a*.

The speaker hole 124*a* of the present invention includes a central portion C with a substantially constant diameter, a front portion F facing from the central portion C toward the front of the refrigerator, and a rear portion R facing from the central portion C toward the interior of the refrigerator. The central portion C is formed to have a substantially constant diameter. The front portion F is shaped as a cone of which diameter is gradually increased toward the front of the refrigerator, while the rear portion R is shaped as a cone of which diameter is gradually increased toward the rear of the refrigerator. As compared with the related art speaker hole, therefore, the diameters of the front and rear portions F and R of the speaker hole 124*a* are gradually increased, and thus, it can be understood that the substantial sectional areas of the front and rear portions F and R are increased.

Accordingly, even though water drops adhere to the mounting panel 124 and the front surface of the refrigerator door 100 or run down into a portion where the speaker hole 124 when cleaning the front surface of the refrigerator door, the water drops stay in the front portion F of the speaker hole 124 of which sectional area is sufficiently expanded. Thus, it is difficult for the water drops to penetrate into the display unit through the central portion C. Although the water drops pass through the front portion F and reach up to the central portion C, they stay in and evaporate from the rear portion R because the sectional area of the rear portion R is sufficiently large as compared with the related art. Thus, it is not easy for the water to substantially penetrate into the display unit. The present invention is basically configured in such a manner that the penetration of water into the display unit can be prevented by substantially increasing the diameter of the front and/or rear portions and thus expanding the sectional area thereof to allow the water to stay therein. In addition, considering surface tension that is exerted on the water drops formed on the front surface of the mounting panel 124 and the front portion F of the speaker hole 124*a*, it can be understood that the aforementioned configuration can fully prevent the water drops from passing through the speaker hole and penetrating into the display unit.

Although both the front and rear portions F and R of the speaker hole 124*a* are configured in such a manner that their diameters are gradually increased as compared with that of the central portion C of the speaker hole 124*a* according to the illustrated embodiment of the present invention, it is obvious that the present invention is not limited thereto. For example, the present invention may be configured in such a manner that the diameter of the front portion F is gradually increased as compared with that of the central portion C, while the diameter of the rear portion R is the same as that of the central portion C.

As discussed above, the basic technical spirit of the present invention is that the resonance box is installed to improve the sound quality of the display unit mounted to the front surface of the refrigerator door. Further, to prevent water drops from penetrating into the display unit through the speaker hole through which the sound is transmitted, at least a front portion of the speaker hole is expanded and thus its sectional area is increased.

In a sound system for a refrigerator mounted with a display unit according to the present invention so configured, a resonance box is installed at the rear of a speaker such that the speaker is enclosed in the resonance box. Therefore, sound generated from the rear of the speaker is also reflected on the resonance box and transmitted forward to the outside, and thus, the low and middle frequency sound characteristics can be improved. Further, since a sound absorbing material is attached to an inner surface of the resonance box facing a rear surface of the speaker, high frequency sound generated from the rear surface can be dissipated into thermal energy in fine holes of the sound absorbing material. Thus, there are advantages in that the occurrence of squealing sound can be prevented and the high frequency sound characteristics can also be improved. Therefore, an effect that the sound system can improve sound quality of the display unit mounted to the refrigerator door is expected.

In addition, the present invention is configured in such a manner that water drops are not introduced into the display unit through speaker holes. Therefore, another effect that the damage of inner components of the display unit due to water can be prevented and thus reliability of the display unit can also be improved is also expected.

It will be apparent that those skilled in the art can make various modifications and changes within the scope of the fundamental technical spirit of the present invention. Therefore, the scope of the present invention should be construed on the basis of the appended claims.

What is claimed is:

1. A display unit for a refrigerator, comprising:

a display mounted to a front surface of the refrigerator;

a mounting panel mounted around an edge of the display and formed with a plurality of speaker holes;

a speaker installed on a rear surface of the speaker holes of the mounting panel and configured to transmit sound; and a resonance box installed to have a predetermined space enough to accommodate the speaker therein and to enclose the speaker, wherein the resonance box further includes a sound transmission tube with a predetermined length installed to communicate with the speaker hole of the mounting panel such that sound generated from the rear surface of the speaker is reflected thereon and transmitted to the outside thereof.

2. The display unit as claimed in claim 1, wherein a sound absorbing material capable of absorbing high frequency sound is covered on the resonance box at an inner surface thereof facing the rear surface of the speaker.

3. The display unit as claimed in claim 2, wherein the sound absorbing material is a porous material on or in which a plurality of fine holes are formed.

4. The display unit as claimed in claim 1, wherein a front portion of each of the plurality of speaker holes is shaped as a forward flared cone.

5. The display unit as claimed in claim 4, wherein a rear portion of each of the plurality of speaker holes is shaped as a rearward flared cone.

6. The display unit as claimed in claim 1, wherein the resonance box is rectangular.

7. A refrigerator comprising the display unit of claim 1.

8. A display unit for a refrigerator, comprising:

a display mounted to a front surface of the refrigerator;

a mounting panel mounted around an edge of the display and formed with a plurality of speaker holes;

a speaker installed on a rear surface of the speaker holes of the mounting panel and configured to transmit sound; and a resonance box installed to have a predetermined space enough to accommodate the speaker therein and to enclose the speaker, wherein a sound absorbing material capable of absorbing high frequency sound is covered on the resonance box at an inner surface thereof facing the rear surface of the speaker.

9. The display unit as claimed in claim 8, wherein the sound absorbing material is a porous material on or in which a plurality of fine holes are formed.

10. A refrigerator comprising the display unit of claim 8.

11. A display unit for a refrigerator, comprising:

a display mounted to a front surface of the refrigerator;

a mounting panel mounted around an edge of the display and formed with a plurality of speaker holes;

a speaker installed on a rear surface of the speaker holes of the mounting panel and configured to transmit sound; and a resonance box installed to have a predetermined space enough to accommodate the speaker therein and to enclose the speaker, wherein a front portion of each of the plurality of speaker holes is shaped as a forward flared cone.

12. The display unit as claimed in claim 11, wherein a rear portion of each of the plurality of speaker holes is shaped as a rearward flared cone.

13. A refrigerator comprising the display unit of claim 11.

14. A display unit for a refrigerator, comprising:

a display mounted to a front surface of the refrigerator;

a mounting panel mounted around an edge of the display and formed with a plurality of speaker holes;

a speaker installed on a rear surface of the speaker holes of the mounting panel and configured to transmit sound; and a resonance box installed to have a predetermined space enough to accommodate the speaker therein and to enclose the speaker, wherein a rear portion of each of the plurality of speaker holes is shaped as a rearward flared cone.

15. A refrigerator comprising the display unit of claim 14.

16. A mounting device for a display device for a refrigerator, comprising:

a mounting panel configured to be mounted around an edge of a display and formed with a plurality of speaker holes; and a resonance box installed to have a predetermined space enough to accommodate and enclose a speaker therein, wherein the resonance box further includes a sound transmission tub with a predetermined length installed to communicate with the speaker hole of the mounting panel such that sound generated from a rear surface of a speaker is reflected thereon and transmitted to the outside thereof.

17. A mounting device for a display device for a refrigerator, comprising:

a mounting panel configured to be mounted around an edge of a display and formed with a plurality of speaker holes; and a resonance box installed to have a predetermined space enough to accommodate and enclose a speaker therein, wherein a sound absorbing material is provided on the resonance box at an inner surface thereof.

18. The mounting device as claimed in claim 17, wherein the sound absorbing material is configured to absorb high frequency sound.

19. The mounting device as claimed in claim 17, wherein the sound absorbing material is a porous material on or in which a plurality of fine holes are formed.

20. A mounting device for a display device for a refrigerator, comprising:

a mounting panel configured to be mounted around an edge of a display and formed with a plurality of speaker holes; and a resonance box installed to have a predetermined space enough to accommodate and enclose a speaker therein, wherein a front portion each of the plurality of speaker holes is shaped as a forward flared cone.

21. The mounting device as claimed in claim 20, wherein a rear portion of each of the plurality of the speaker holes is shaped as a rearward flared cone.

22. A mounting device for a display device for a refrigerator, comprising:

a mounting panel configured to be mounted around an edge of a display and formed with a plurality of speaker holes; and a resonance box installed to have a predetermined space enough to accommodate and enclose a speaker therein, wherein a rear portion of each of the plurality of the speaker holes is shaped as a rearward flared cone.

* * * * *